US007401484B1

(12) United States Patent
Holmes et al.

(10) Patent No.: US 7,401,484 B1
(45) Date of Patent: Jul. 22, 2008

(54) LOW PROFILE, LOCKABLE HANDLE, HOUSING AND COVER ASSEMBLY

(75) Inventors: Matthew L. Holmes, Janesville, WI (US); Brian M. Ott, Huntley, IL (US)

(73) Assignee: The Eastern Company, Wheeling, IL (US)

( * ) Notice: Subject to any disclaimer, the term of this patent is extended or adjusted under 35 U.S.C. 154(b) by 375 days.

(21) Appl. No.: 11/285,002

(22) Filed: Nov. 22, 2005

(51) Int. Cl.
*E05B 13/02* (2006.01)

(52) U.S. Cl. ..... 70/423; 70/455; 70/224; 292/DIG. 63; 292/347; 292/336.3

(58) Field of Classification Search ..... 70/423, 70/424, 455, 207–210, 215, 216, 224, 159, 70/165; 292/DIG. 63, 347, 349, 336.3
See application file for complete search history.

(56) References Cited

U.S. PATENT DOCUMENTS

| | | | | | |
|---|---|---|---|---|---|
| 2,213,814 | A | | 9/1940 | Jacobi | 70/455 |
| 2,303,594 | A | * | 12/1942 | Wise | 70/165 |
| 2,343,605 | A | * | 3/1944 | Wise | 70/455 |
| 2,355,300 | A | * | 8/1944 | Johnstone | 70/455 |
| 2,388,228 | A | * | 10/1945 | Johnstone | 70/455 |
| 2,391,498 | A | * | 12/1945 | Wise | 70/172 |
| 2,400,229 | A | * | 5/1946 | Freeman | 70/455 |
| 2,562,038 | A | * | 7/1951 | Jacobi | 70/455 |
| 2,602,319 | A | * | 7/1952 | Jocobi | 70/455 |
| 2,702,468 | A | * | 2/1955 | Spain | 70/455 |
| 3,898,824 | A | * | 8/1975 | Borlinghaus | 70/455 |
| 3,930,391 | A | | 1/1976 | Borlinghaus | 70/455 |
| 4,073,165 | A | | 2/1978 | Grundstrom et al. | 70/371 |
| 4,192,161 | A | * | 3/1980 | Borlinghaus | 70/455 |
| 4,597,274 | A | | 7/1986 | Coscia et al. | 70/455 |
| 4,655,059 | A | | 4/1987 | Best et al. | 70/224 |
| 4,674,308 | A | * | 6/1987 | Peters | 70/455 |
| 4,687,124 | A | * | 8/1987 | Mahr | 224/42.24 |
| 4,723,428 | A | * | 2/1988 | Yamaguchi | 70/455 |
| 4,773,240 | A | | 9/1988 | Foshee | 70/222 |
| 4,773,242 | A | * | 9/1988 | Smith | 70/455 |
| 4,881,391 | A | * | 11/1989 | Villa et al. | 70/455 |
| 5,241,846 | A | * | 9/1993 | Hoke | 70/455 |
| 5,586,459 | A | * | 12/1996 | Bullock et al. | 70/224 |
| 5,718,137 | A | * | 2/1998 | Huston | 70/423 |
| 5,794,472 | A | | 8/1998 | Kester et al. | 70/472 |
| 6,272,890 | B1 | * | 8/2001 | Huston | 70/423 |
| 6,309,008 | B1 | * | 10/2001 | Bacon | 296/106 |
| 6,530,250 | B1 | * | 3/2003 | Linares et al. | 70/208 |
| 6,640,593 | B1 | * | 11/2003 | Hannah et al. | 70/224 |
| 2006/0090527 | A1 | * | 5/2006 | Terhaar et al. | 70/208 |

* cited by examiner

*Primary Examiner*—Suzanne D Barrett
(74) *Attorney, Agent, or Firm*—David A. Burge

(57) ABSTRACT

A handle, housing and cover assembly includes an relatively thick oval handle sandwiched between a relatively thin oval housing base and a relatively thin oval cover. The oval exteriors of these three relatively movable components are of substantially the same size and shape, and align when the cover is closed and when the handle is in its normal, non-operated position to provide a low profile stack of components that can nest comfortably within the palm of one's hand so the palmed cover can be moved by gentle hand pressure between closed and open positions, and so the handle can be pivoted by fingertip pressure between non-operated and operated positions. The cover, when open, provides access to a keyway into which a key can be inserted and turned to selectively prevent and permit turning of the handle relative to the housing base.

27 Claims, 5 Drawing Sheets

LOW PROFILE, LOCKABLE HANDLE, HOUSING AND COVER ASSEMBLY

REFERENCE TO CONCURRENTLY-FILED DESIGN APPLICATION

Filed concurrently herewith by the inventors named herein is a design application entitled FRONT PORTIONS OF AN OVAL HANDLE AND HOUSING ASSEMBLY WITH PIVOTAL COVER 29/243,279, the disclosure of which is incorporated herein by reference.

BACKGROUND OF THE INVENTION

Handle and housing assemblies having a handle that can be grasped and turned about an axis to operate an auxiliary mechanism such as an associated latch (or a set of associated latches) are known and used widely to latch and lock such closures as the tailgates and tonneau covers of pickup trucks, sport utility vehicles and the like.

To minimize the possibility of clothing or belongings of passers being inadvertently hooked or caught on handle and housing assemblies used in motor vehicle applications, and taking into account other concerns of appearance and safety, handle and housing assemblies having rounded exterior surfaces and low profiles have been proposed. Some proposals have included pivotal covers to shield and conceal lock cylinder keyways.

A problem common to many of these proposals is that their relatively movable handle, housing and cover components have proved difficult to grasp and operate, especially for persons wearing gloves or for persons afflicted with infirmities such as arthritis. Designing a handle, housing and cover assembly that incorporates attractive, easy to grasp and operate handle and cover components which cooperate with a housing to provide suitably rounded exterior surfaces and a desirably low profile has presented more of a challenge than one might expect.

SUMMARY OF THE INVENTION

The present invention addresses the foregoing and other drawbacks of the prior art by providing an easy to grasp and position set of relatively movable handle, housing and cover components that are of oval shape and arranged in a stack with the thickest of the oval shaped components, namely the handle, being sandwiched between a relatively thin oval shaped housing base and a relatively thin oval shaped cover—an arrangement that permits the handle to be pivoted between its non-operated and operated positions by fingertip pressure applied to its lengthy opposed side surfaces when the palm of one's hand overlies the cover in a manner that also facilitates using gentle palm pressure applied to the cover's front surface to move the cover between its open and closed positions.

Some embodiments of the invention provide a low profile handle, housing and cover assembly that includes a relatively thick oval shaped handle sandwiched between a relatively thin oval shaped housing base and a relatively thin oval shaped front cover wherein adjacent pairs of these relatively movable, oval shaped components are pivotally connected to turn about separate forwardly-rearwardly extending axes, including a central axis about which the handle may turn relative to the housing, and an auxiliary axis offset from the central axis about which the cover may turn relative to the handle.

Some embodiments of the invention provide a low profile handle, housing and cover assembly including a relatively thick oval shaped handle sandwiched between a relatively thin housing base and a relatively thin cover with the handle being capable of being turned approximately a quarter turn in one direction about a forwardly-rearwardly extending central axis of the assembly to move the handle from a non-operated position to an operated position, and with the cover being capable of being turned approximately a quarter turn in an opposite direction about a different forwardly-rearwardly extending axis to move the cover from a closed position to an open position wherein the cover provides access to a keyway of a lock cylinder that is shielded by the cover when in the closed position. When the cover is open, a key can be inserted into and turned while within the keyway to selectively lock the handle to the housing to prevent turning of the handle about the central axis relative to the housing, and to unlock the handle from the housing to permit turning of the handle relative to the housing.

Some embodiments of the invention provide a lockable handle, housing and cover assembly that has 1) a relatively thin housing base bounded by a first oval perimeter surface, 2) a relatively thicker handle overlying the housing base that can be pivoted (relative to the housing base about an axis that extends forwardly from the housing base) between a non-operated position wherein a second oval perimeter surface of the handle aligns with and extends forwardly from the first oval perimeter surface of the base, and an operated position wherein the second oval perimeter surface disaligns with the first oval perimeter surface, and 3) a relatively thin cover overlying the handle that is movable (relative to the handle between a closed position wherein a third oval perimeter surface of the cover substantially aligns with the second oval perimeter surface of the handle, and an open position wherein the cover disaligns with the second oval perimeter surface and provides access to a keyway of a lock cylinder of the assembly to enable a key to be inserted into and turned within the keyway to lock and unlock the lock cylinder to selectively prevent and permit turning of the handle relative to the housing). In such embodiments, movement of the cover between its open and closed positions can easily be effected by applying palm pressure to a front surface of the relatively thin oval cover; and movement of the handle between its non-operated and operated positions can easily be effected by applying fingertip pressure to opposed side surfaces of the relatively thick oval handle.

In some embodiments, at least a selected one of the oval shaped handle and cover components is provided with an apron formation configured to overlie an upwardly opening groove defined by the other of the handle and cover components, with the apron formation and the groove being configured to cooperate in ducting rain water away from where the cover overlies the handle to thereby inhibit entry of rainwater into a keyway that is shielded by the cover when the cover is in the closed position.

In some embodiments, the oval perimeters of the housing base, the handle and the cover cooperate when in their normal orientations (i.e., with the cover closed and the handle non-operated) to define a low profile stack of components that tapers so as to narrow slightly in width and length as the perimeter of the stack extends forwardly. The tapered configuration of the stack, and a recessed front surface of the cover cooperate to provide a set of relatively movable components that can nest comfortably within the palm of one's hand so palm pressure on the cover can be used to move the cover relative to the handle, and so fingertip pressure on opposed side surfaces of the handle can be used to pivot the handle relative to the housing base.

In some applications that employ features of the invention, a cam may be connected to a rear portion of the handle to be turned about the central axis of a handle, housing and cover assembly in unison with the handle, by which arrangement the cam is caused to move into and out of engagement with a suitably configured strike or strike-defining cabinet structure to latch in closed position a closure on which the handle, housing and cover assembly may be mounted, for example in the manner in which the cams of cam locks are caused to move into and out of engagement with suitably configured strikes or other structure, as disclosed in cam lock patents assigned to The Eastern Company that include U.S. Pat. Nos. 4,145,978, 3,438,227, 3,336,774 and 2,938,373 (referred to hereinafter as the Referenced Cam Lock patents, the disclosures of which are incorporated herein by reference).

In some applications that embody features of the invention, a cam may be connected to a rear portion of the handle to be turned about the central axis of a handle, housing and cover assembly in unison with the handle for the purpose of causing one or more links to translate to operate one or more remotely located latches. Patents assigned to The Eastern Company that disclose cams or wheels which can turn about a central axis to cause opposed translation of a pair of links to operate pairs of remotely located latches include U.S. Pat. Nos. 3,333,878, 2,729,089 and 2,069,883 (referred to hereinafter as the Referenced Linkage Operated Latching System patents, the disclosures of which are incorporated herein by reference).

BRIEF DESCRIPTION OF THE DRAWINGS

These and other features, and a fuller understanding of the invention may be had by referring to the following description and claims taken in conjunction with the accompanying drawings, wherein:

DETAILED DESCRIPTION

Figure 1:
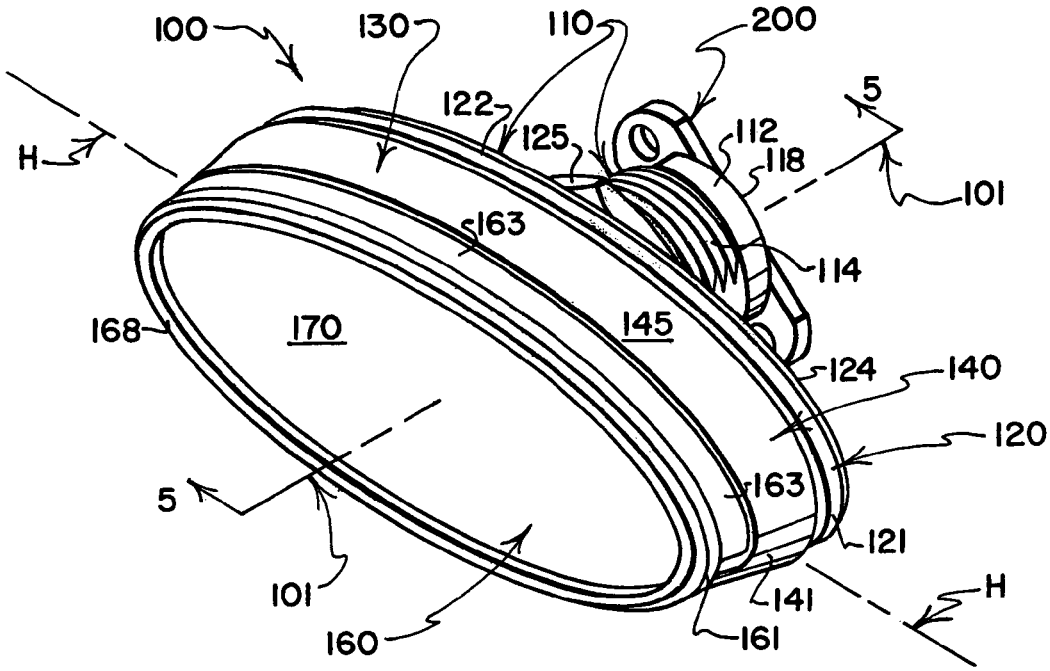
FIG. 1 is a perspective view showing a low profile, lockable handle, housing and cover assembly with the cover thereof in its closed position, with the handle thereof in its normal, non-operated position, and with a rear mounted cam also in a normal, non-operated position.

Referring to FIGS. 1-5, a handle, housing and cover assembly 100 includes a handle 130 that can be turned about a forwardly-rearwardly extending central axis 101 of the assembly 100 relative to a housing 110 of the assembly 100 through a limited range of angular movement to cause a cam 200 located at the rear of the assembly 100 to turn in unison with the handle 130 through an identical range of angular movement.

The assembly 100 has a low profile front portion defined in large measure by three relatively movable oval shaped components, namely a relatively thin base 120 of the housing 110 which is bounded by an oval shaped perimeter surface 121, a relatively thick front portion 140 of the handle 130 (also referred to as the "handle front 140") which is bounded by an oval shaped perimeter surface 141, and a thin cover 160 which is bounded by an oval shaped perimeter surface 161.

Figure 2:
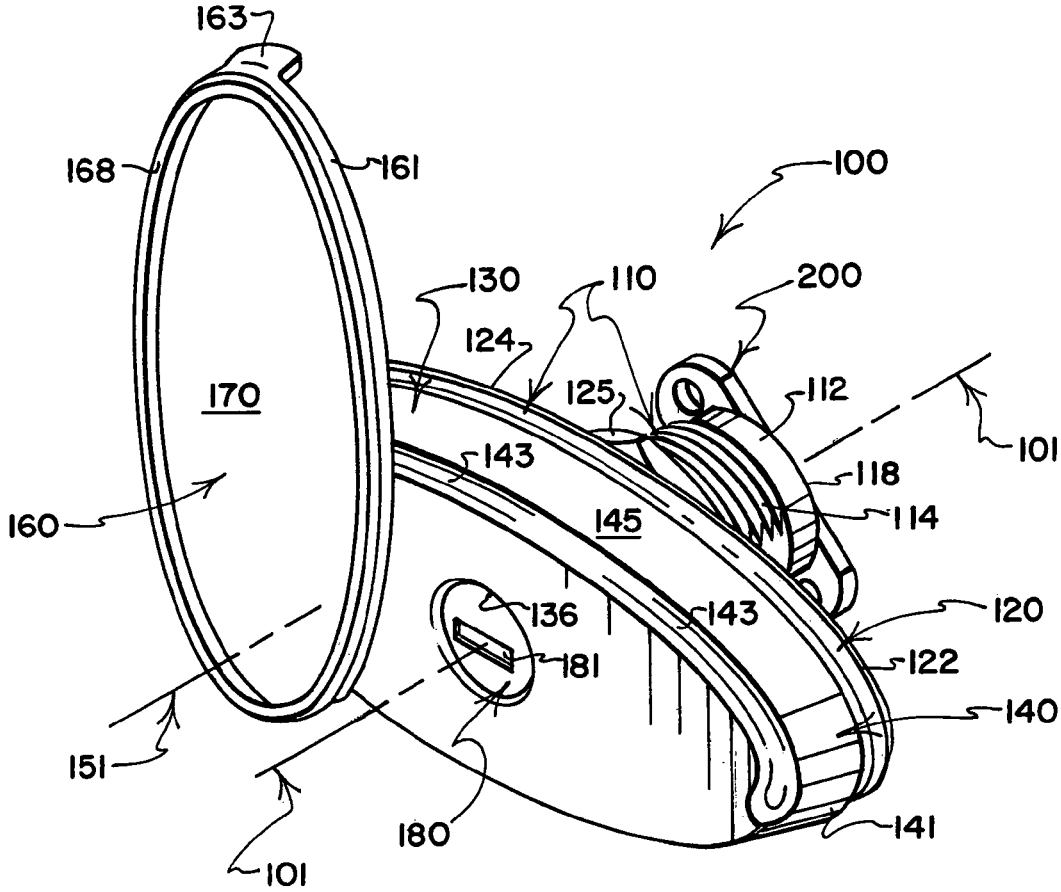
FIG. 2 is a perspective view similar to FIG. 1, but with the oval cover turned to its open position that provides access to a forwardly opening keyway of a lock cylinder of the assembly.

Referring to FIGS. 1 and 2, the oval shaped cover 160 can turn approximately a quarter turn relative to the oval shaped handle front 140 about a forwardly-rearwardly extending auxiliary axis 151 between a closed position shown in FIG. 1 and an open position shown in FIG. 2. The auxiliary axis 151 about which the cover 160 pivots parallels the central axis 101 but is spaced therefrom, and intersects overlying end regions of the oval shaped cover 160 and the oval shaped handle front 140. When the cover 160 is open (i.e., in the open position depicted in FIG. 2), access is provided to a forwardly opening keyway 181 of the lock cylinder 180. When the cover 160 is closed (i.e., in the closed position depicted in FIG. 1), the cover 160 protectively overlies the lock cylinder 180 to shield and conceal the lock cylinder 180 and its keyway 181, thereby blocking access to the keyway 181.

Figure 3:
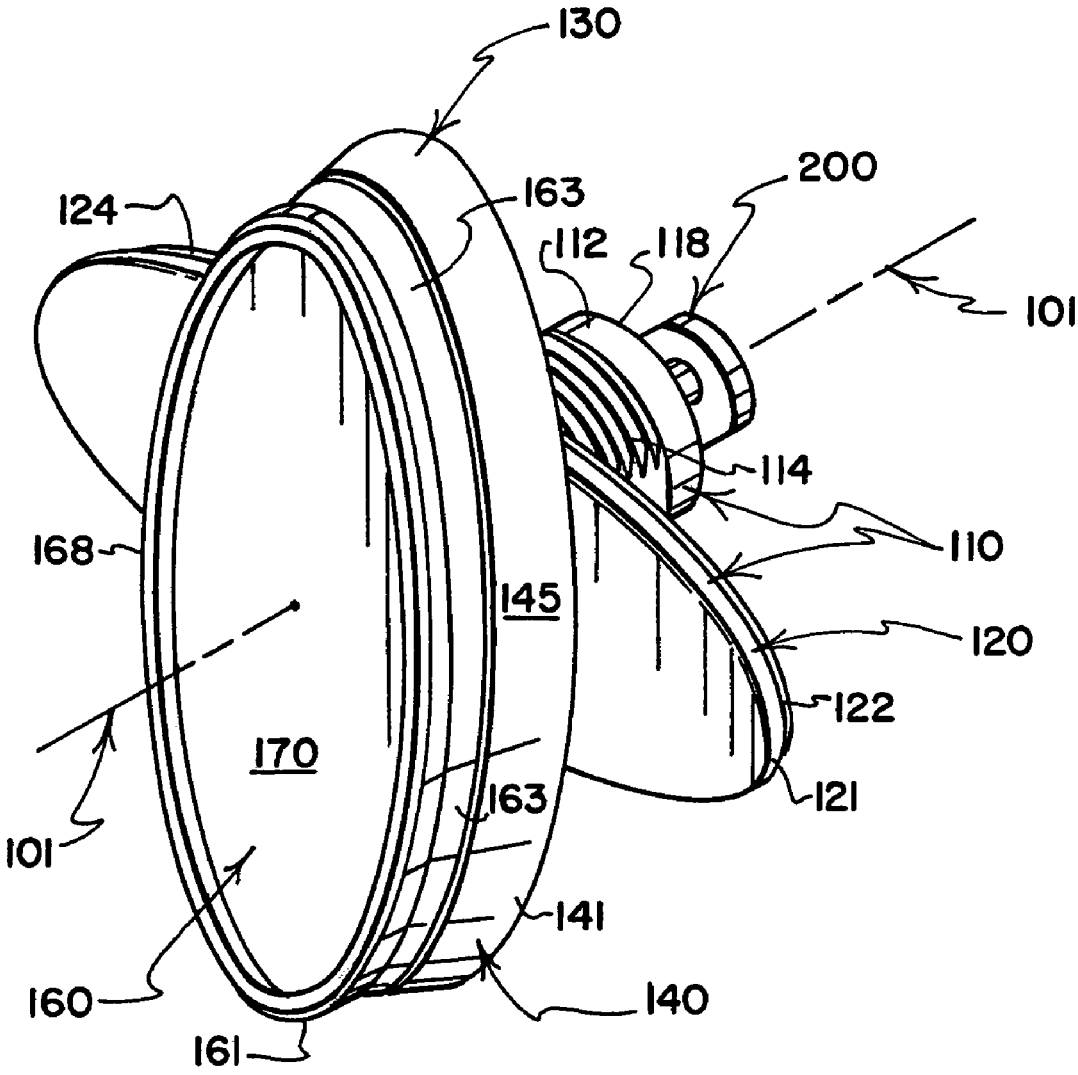
FIG. 3 is a perspective view similar to FIG. 1, but with the oval cover closed and turned, together with the oval handle, to the operated position of the oval handle thereby exposing to view a part of a front surface of the base of the oval housing of the assembly, with the rear mounted cam being turned to an operated position.

Referring to FIGS. 1 and 3, the handle 130 can turn about a quarter turn relative to the housing 110 about the central axis 101 of the assembly 100 between a normal, non-operated position shown in FIG. 1, and an operated position shown in FIG. 3. Normally, the cover 160 is pivoted to the closed position of FIG. 1 before the handle 130 is turned from its normal, non-operated position, and remains closed when the handle 130 is pivoted away from its normal, non-operated position. However, it is not essential that the cover 160 remain closed at times when the handle 130 is pivoted out of its normal, non-operated position.

Figure 4:
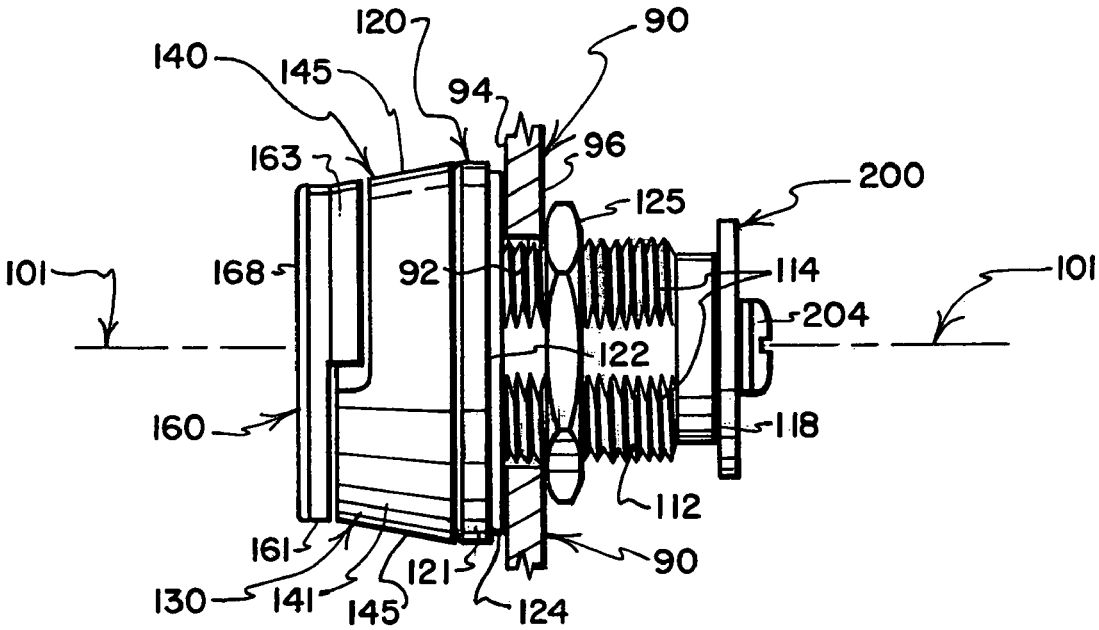
FIG. 4 is a side view of the assembly of FIG. 1, with portions of a closure or panel on which the assembly may be mounted shown in cross-section.
Figure 5:
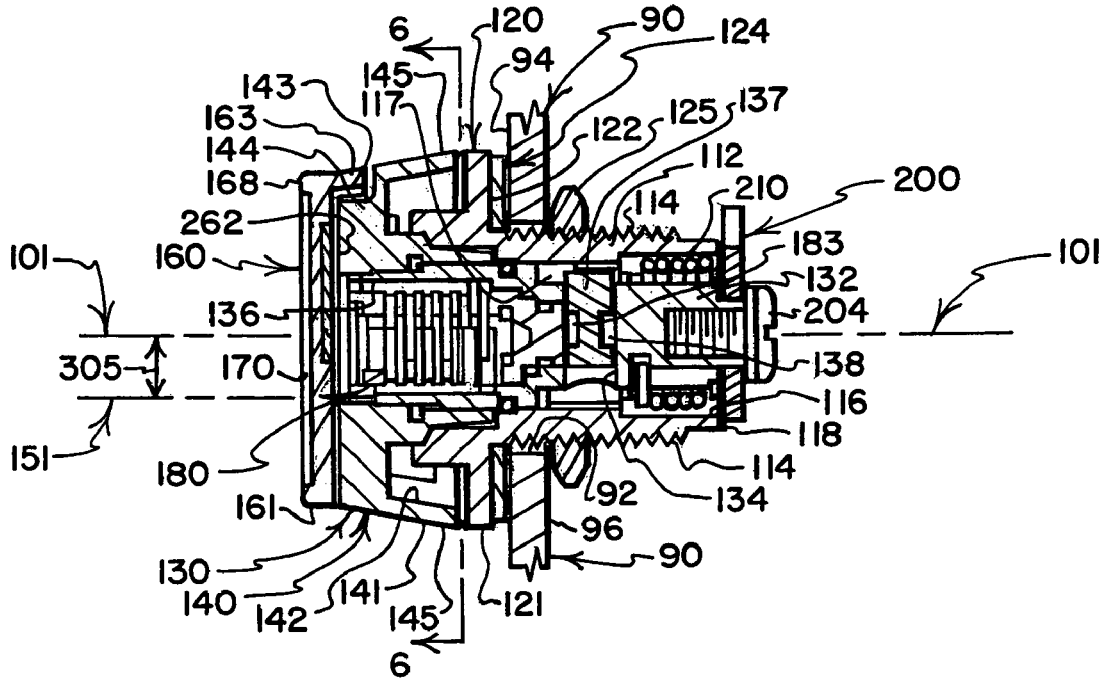
FIG. 5 is a cross-sectional view as seen from a plane indicated by a line 5-5 in FIG. 1, with the mounting panel of FIG. 4 also shown in cross-section.

Referring to FIGS. 4 and 5, the housing 110 has a tubular rear portion 112 which extends rearwardly along the central axis 101 from a rearwardly facing surface 122 of the housing's thin, oval front portion 120. Threads 114 are provided on exterior surface areas of the rear portion 112. An oval gasket 124 covers much of the rearwardly facing surface. When the assembly 100 is installed on a thin structure such as the depicted panel 90, the gasket 124 is compressed against a front face 94 of the panel 90 when a nut 125 installed on the threads 114 is tightened against a rear face 96 of the panel 90 at a time after the housing's rear portion 112 has been inserted through an opening 92 of the panel 90.

Figure 8:
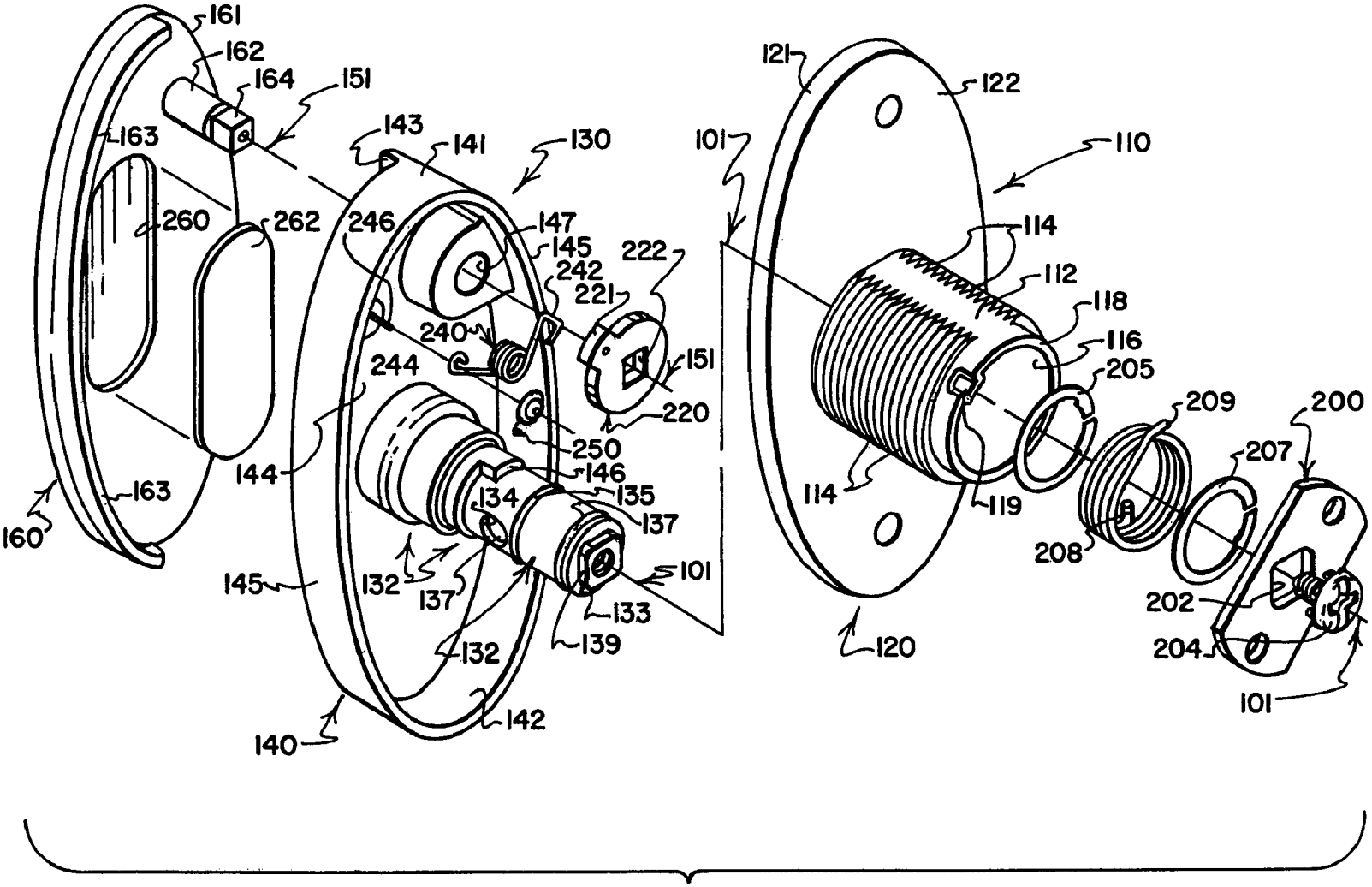

Referring to FIGS. 5 and 8, an internal passage 116 extends through the housing 110 along the central axis 101. A forwardly-rearwardly extending groove indicated by the numeral 117 in FIG. 5 opens into the passage 116 toward the axis 101 (in a central region of the passage 116 where the passage 116 has a smaller diameter than is exhibited by the passage 116 nearer its opposite ends). A rear wall 118 of the tubular rear portion 112 of the housing 110 is provided with a recess 119 (see FIG. 8) that not only opens rearwardly but also opens into the passage 116. The cam 200 moves along the rear wall 118 as it pivots about the central axis 101 in response to turning of the handle 130.

Referring still to FIGS. 5 and 8, the handle 130 has a generally cylindrical portion 132 which extends rearwardly along the central axis 101 from the handle's oval shaped front portion 140. A hole 134 extends trans-versely through the handle's rearwardly extending portion 132 at a location midway along the length thereof, and a transversely movable tumbler 137 is carried in the hole 134. As will be explained shortly, the key operated lock cylinder 180 is operable to extend and retract the tumbler 137 into and out of the forwardly-rearwardly extending housing groove 117 (FIG. 5) to selectively lock the handle 130 to, and unlock the handle 130 from, the housing 110. By this arrangement, turning of the handle 130 about the central axis 101 relative to the housing 110 either is prevented or permitted depending on whether the lock cylinder 180 retracts the tumbler 137 from the groove 117, or extends the tumbler 137 into the groove 117. In FIG. 5, the tumbler 137 is shown extended into the housing groove 117 to prevent the handle 130 from turning relative to the housing 110.

Figure 6:
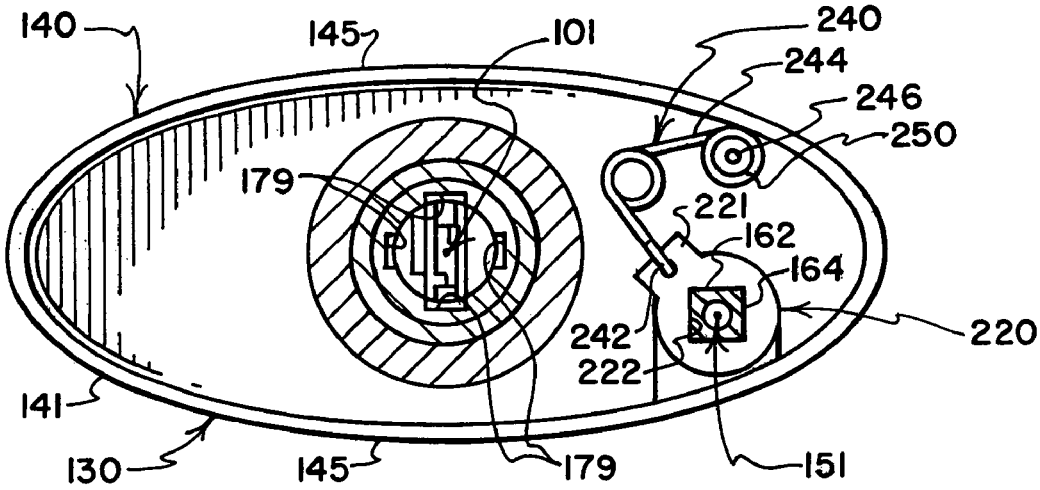
FIG. 6 is a cross-sectional view as seen from a plane indicated by a line 6-6 in FIG. 5.
Figure 7:
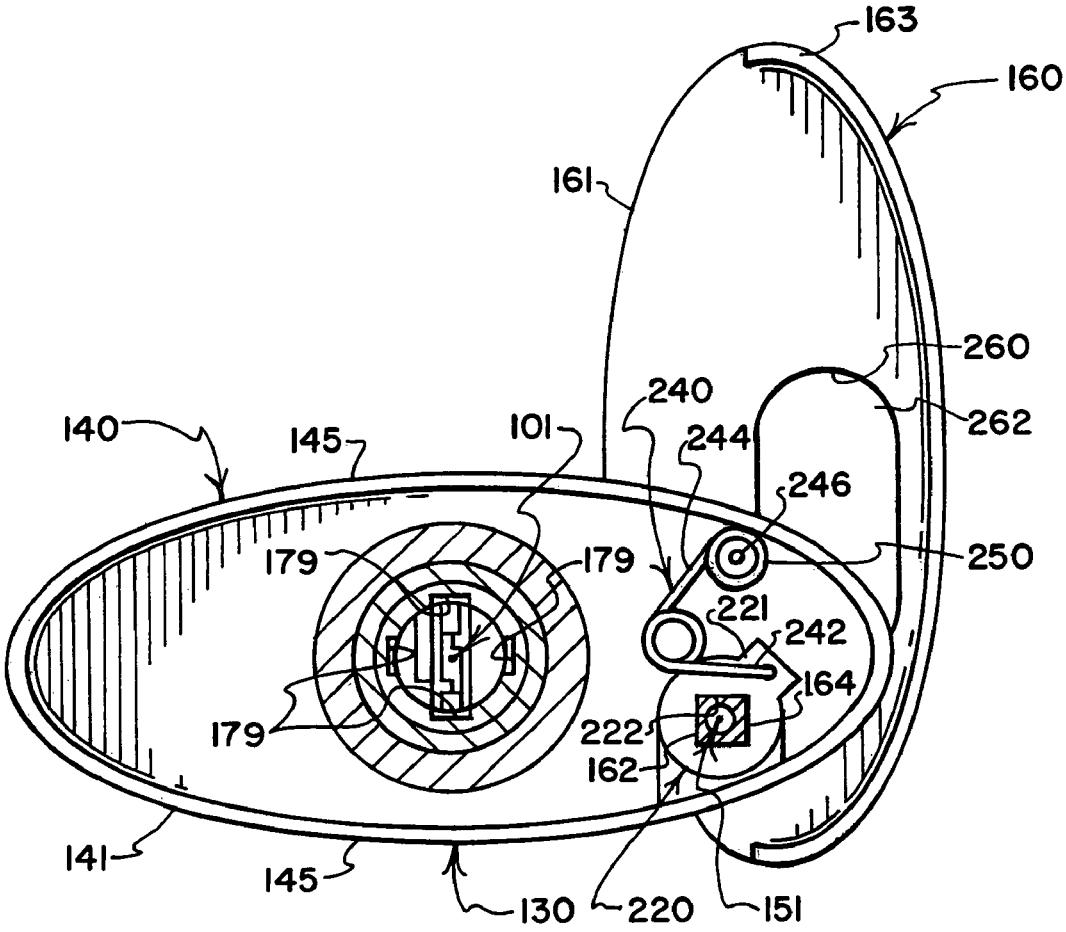
FIG. 7 is a cross-sectional view similar to FIG. 6 but with the oval cover of the assembly turned to the open position of FIG. 2; and, FIG. 8 is an exploded perspective view depicting selected components of the handle, housing and cover assembly.

Referring to FIGS. 2 and 5, the lock cylinder 180 is carried within in a forwardly opening internal passage 136 of the handle 130 that extends along the central axis 101. The lock cylinder 180 is configured in a conventional manner to permit a suitably configured key (not shown) to be inserted into the keyway 181 and turned (while within the keyway 181) about the central axis 101 to turn the cylinder 180 through about a quarter turn range of movement in clockwise and counterclockwise directions of rotation. If it is desired to retain the cylinder 180 at one or the other of the opposite ends of its quarter turn range of movement, the key used to turn the cylinder 180 can be removed from the keyway 181, and this will cause conventional tumblers carried by the cylinder 180 to extend from opposite sides of the cylinder 180 and into one or more of the four grooves 179 that are shown in FIGS. 6 and 7 so the cylinder 180 cannot be turned about the axis 101 when the key is removed from the keyway 181.

Referring to FIG. 5, extending from the rear of the lock cylinder 180 is a small, generally cylindrical, eccentric cam formation 183 that projects into a groove 138 of the tumbler 137—a groove that extends perimetrically about a central portion of the tumbler 137 so the tumbler 137 can turn in the hole 134 while the cam formation 183 continues to extend into its groove 138. The cam formation 183 is eccentric in that it is not concentric about the central axis 101, but rather is offset from the central axis, which enables the cam formation 183 (by virtue of its eccentric extension into the groove 138 of the tumbler 137) to cause the tumbler 137 to translate along the length of the hole 134 in response to clockwise or counterclockwise quarter turn movements of the lock cylinder 180 about the central axis 101. Thus, inserting and effecting a quarter turn movement of a key in the keyway 181 of the lock cylinder 180 causes the tumbler 137 either to translate into the housing groove 117 to lock the handle 130 to the housing 110 (and thus prevent the handle 130 from turning about the axis 101 relative to the housing), or to unlock the handle 130 from the housing 110 (and thus permit the handle 130 to turn about the axis 101 relative to the housing 110.

Referring to FIG. 8, a radially and rearwardly projecting lug formation 146 of generally square shape is provided at a central location along the length of the handle's rearwardly extending portion 132. In a manner well known to those skilled in the art, the lug formation 146 cooperates with stop surfaces (not shown) that are formed along the interior wall of the housing passage 116 to limit turning of the handle 130 (about the central axis 101 relative to the housing 110) to about a quarter turn of rotational movement as the handle 130 turns from its normal, non-operated position as depicted in FIG. 1 to its operated position as depicted in FIG. 3.

Referring to FIG. 8, the handle 130 is biased toward its normal, non-operated position by a torsion coil spring 210 that is installed on the handle's rearwardly extending portion 132 and that is drivingly connected to the handle's rearwardly extending portion 132 by virtue of a radially inwardly turned front end 208 of the spring 210 extending into a groove 133 of the handle 130 that extends axially along a rear end region of the handle's rearwardly extending portion 132. An outwardly deflected rear end 209 of the spring 210 is connected to the housing 110 by extending into and being retained within the previously described housing recess 119 which opens inwardly and rearwardly adjacent the rear end 118 of the housing 110.

At spaced locations along the rear part of the handle's rearwardly extending portion 132, circumferentially extending grooves 135, 137 may be provided to receive snap rings 205, 207 which may be used to retain the handle's rearwardly extending portion 132 and the spring 210 in place within the housing passage 116. Typically at a time after all other components depicted in FIG. 8 have been put in place to form the assembly 100, the cam 200 (or a different cam, not shown, suitable for the particular application for which the assembly 100 is to be used) is installed on the rear end of the handle 130 by mating a square hole 202 of the cam 200 to a square rear end formation 139 of the handle 130, by threading a fastener such as the depicted screw 204 into a threaded hole at the rear of the handle 130, and by tightening the screw 204 against a rear surface of the cam 200.

Referring to FIGS. 5 and 8, the oval perimeter surface 141 of the front portion 140 of the handle 130 is defined in large measure by a thin side wall 142 that extends rearwardly from a front wall 144. Long, gently curved opposed side surfaces or regions 145 of the oval perimeter surface 141 are well suited to be gripped by fingertips of one's hand at a time when the palm of one's hand nests the front cover 160, so that fingertip pressure can be applied to the handle's front portion 140 to turn the handle 130 about the central axis 101.

Returning to FIG. 8, near one of the two opposite end regions of the oval shaped front portion 140 of the handle 130, a passage 147 is formed through the front wall 144 of the handle's front portion 140. The passage 147 extends along the auxiliary axis 151 and, in fact, defines the location of the auxiliary axis 151. A stub shaft 162 of the cover 160 (formed integrally with other portions of the cover 160) extends through the passage 147 and is journaled by the passage 147 to pivotally connect the cover 160 to the handle's front portion 140.

As can be seen in FIGS. 6-8, the stub shaft 162 is provided near its rear end with a square drive formation 164 which extends into a square hole 222 of a spring connection device 220. The connection device 220 has a radially extending arm formation 221, and is protectively housed within the area (surrounded by the handle's thin side wall 142) located between the handle's front wall 144 and the front face of the housing's front portion 120. Also enclosed within the same space is a torsion spring 240 which has one end region 242 hooked through a hole formed through the arm formation 221, and another end 244 region hooked about a pin formation 246 of the handle front 140 that extends rearwardly from the front wall 144 of the front 140 of the handle 130. A spring steel washer 250 is installed on the pin formation 246 to retain the spring end 244 in place. The torsion spring 240 normally biases the cover 160 toward the cover's closed position as depicted in FIG. 1; however, as the cover 160 is pivoted from the closed position of FIG. 1 toward the open position of FIGS. 2 and 7, the connection device 220 pivots (compare the positions of the device 220 shown in FIGS. 6 and 7) to an orientation shown in FIG. 7 that causes the spring 240 to bias the cover 260 toward the open position of FIGS. 2 and 7.

Referring to FIGS. 7 and 8, an elongate, rearwardly opening recess 260 is defined by the cover 160. The recess 260 opens toward the front face of the front wall 144 of the handle front 140 and carries a glide block 262 formed from nylon (or other suitable friction diminishing material) that projects rearwardly a short distance into the space between the cover 160 and the handle front 140 to smooth turning movements of the cover 160 relative to the handle front 140.

Referring to FIGS. 1-3 and 5, it will be seen that the front face of the cover 160 includes a forwardly extending rim 168 that extends continuously perimetrically about a recessed, relatively flat front surface 170. The rim 168 and the recessed flat front surface 170 are well suited to nest within the palm of one's hand and to receive palm pressure applied by the hand for the purpose of gently turning the cover 160 in opposition to the gentle biasing action of the torsion spring 240 to pivot the cover 160 between its closed position shown in FIG. 1 and its open position shown in FIG. 2.

As is probably best seen in FIG. 1, when the handle 130 is in its normal, non-operated position and the cover 160 is in its closed position, the oval perimeter surfaces 121, 141, 161 of the housing base 120, the handle's front portion 140 and the cover 160 preferably extend substantially contiguously in a smooth and essentially uninterrupted manner as the aligned surfaces 121, 141, 161 project away from the location of the rearwardly facing surface 122 of the housing 110. In preferred practice, the surfaces 121, 141, 161 all are slightly tapered (typically by only about one or two degrees) so the exterior continuum of the front part of the assembly 100 defined by the surfaces 121, 141, 161 narrows slightly, but only slightly—and therefore, for all practical purposes, the ovals defined by the surfaces 121, 141, 161 can legitimately be described as being "of substantially the same size and shape."

What seems to be true is that, the approach of providing the contiguously extending surfaces 121, 141, 161 with a slight taper that diminishes the sizes of the ovals defined by these surfaces as the surfaces 121, 141, 161 extend forwardly, the resulting assembly 100 has a pleasant "feel" and generates a degree of acceptance that is beneficial, and encourages one to grasp the stacked array of components depicted in FIG. 1 in the manner intended, with the palm of one's hand overlying the cover 160, and with fingertips aligned with the opposed side surfaces 145 of the handle front 140.

To nest comfortably within the palm of the hand of average American owners of pickup trucks (for use on tailgates and tonneau covers thereof, and similar applications), it is preferred that the sizes of the ovals defined by the gently tapering surfaces 121, 141, 161 be about 4 to about 4.6 inches in length and about 1.8 to about 2.1 inches in width. Other oval configurations, sizes and shapes may be deemed appropriate for use in other applications.

In preferred practice, the assembly 100 is installed (for example, on the panel 90 depicted in FIGS. 4 and 5) to extend substantially horizontally (i.e., in a manner that causes the longest length dimensions of the ovals defined by the surfaces 121, 141, 161 to extend horizontally in a plane such as is indicated in FIG. 1 by the line H-H).

By orienting the assembly 100 to extend horizontally in this manner (so that the lengths of the ovals defined by the surfaces 121, 141, 161 extend substantially horizontally when the cover 160 is closed and the handle front 140 is in the non-operated position shown in FIG. 1), an apron and rain diverting groove formations (which are explained next—that optionally may be provided to extend along upper portions of the cover 160 and the handle front 140 (near the juncture of upper portions of these relatively movable components) are permitted to serve the very useful function of ducting rain water away from the space between the cover 160 and the handle front 140 to minimize the possibility of rain water entering and traveling through the space between the handle front 140 and the cover 160 to enter either the keyway 181 or the handle passage 136 that carries the lock cylinder 180.

Referring to FIG. 5, it will be seen that a top portion of the cover's perimeter surface 161 extends rearwardly to provide an apron formation 163 that overlies an upwardly opening groove formation 143 (see also FIG. 2) of the handle front 140. The apron formation 163 extends the full width of the top side of the assembly 100, as does the groove formation 143—by which arrangement, rainwater is diverted by the apron 163 to either run away from the juncture of the cover 160 and the handle front 140, or is diverted into the upwardly opening groove 143 and ducted to one or the other of the opposite ends of the handle front 140, well away from the area where the keyway 181 opens forwardly at a location behind the cover 160.

Because the auxiliary axis 151 preferably is located a significant distance away from the central axis 101, and because the auxiliary axis 151 preferably is located at least a short distance below the horizontal plane H-H (such a distance is indicated by the numeral 305 in FIG. 5), pivotal movement of the cover 160 about the auxiliary axis 151 from the closed position of FIG. 1 to the open position of FIG. 2 will cause the apron formation 163 to raise and move away from the groove formation 143 as the cover 160 opens—an arrangement which assures that the apron formation 163 and the groove formation 143 will not interfere with pivotal movements of the cover 160 between its open and closed positions.

As those skilled in the art will readily understand and appreciate, the cam 200 may cooperate with a suitably configured strike or other structure (not shown) to directly perform a latching function, for example in a manner disclosed in the referenced Cam Lock patents. Alternatively, in a manner disclosed in the referenced Linkage Operated Latching System patents, the cam 200 may connect with one or a plurality of links (not shown) to cause one or more remotely located latches (not shown) to operate alone or in unison. Those skilled in the art will readily recognize that the handle, housing and cover assembly 100 also can be put to many other uses, not just in applications that involve a latching function, including uses that may exceed present day contemplation.

As will be apparent from the foregoing, a feature of the assembly 100 resides in its provision of a set of three oval shaped relatively movable components that overlie each other and cooperate to define a low profile stack that can nest comfortably within the palm of one's hand so hand pressure can be applied to the cover 160 to move the cover 160 between open and closed positions, and so the sizable opposed side surfaces 145 of the handle front 140 can receive fingertip pressure to turn the handle 130 between non-operated and operated positions. In preferred practice, the oval handle front 140 is relatively thick so the lengthy opposed side surfaces 145 defined by its oval shaped perimeter surface 141 provide sufficient surface area to be grasped and turned by one's fingertips; and, in preferred practice, the handle front 140 is sandwiched between a relatively thin housing base 120 and a thin cover 160, with the thin housing front 120 serving to space the handle front 140 a short distance away from the front surface of a panel 90 or the like on which the assembly 100 is mounted, and with the cover 160 fronting the stack so the front face 170 of the cover 160 can be engaged by the palm of one's hand when the fingers of the hand extend about the opposite side surfaces 145 of the handle front 140, by which arrangement either or both of the handle front 140 and the cover 160 may be turned as desired.

By arranging the cover 160 to pivot in one direction when being opened (so the handle can be unlocked from the housing 110 for pivotal movement while also arranging the handle 130 to pivot in the opposite direction when being operated), the cover 160 can be pivoted back to its closed position (by a combination of palm pressure applied to the cover, and operation of the cover return spring 240) in a single smooth movement that may continue once the cover 160 reaches its closed position—with the continued turning movement then serving to further rotate the cover 160 and the handle 130 in unison as the handle moves from its non-operated position to its operated position—whereupon one's grasp on the assembly 100 then may be released so the handle return spring 210 can return the handle 130, together with the cover 160, to the positions depicted in FIG. 1.

A feature of the described arrangement of oval shaped components 120, 140, 160 is that the oval shaped perimeter surfaces 121, 141, 161 define a low profile front of the assembly 100 having a configuration that can be said to be "mirror image symmetrical" about any plane that contains the forwardly-rearwardly extending central axis 101. Stated in another way, if the structure bounded by the perimeter surfaces 121, 141, 161 is bisected by any plane that contains the central axis 101, the resulting "halves" will constitute mirror images of each other—mirror images of identical size and shape, except that each has an appearance that is a mirror image reversal of the other. By this arrangement, the front of the assembly 100 will nest equally comfortably in the palm of one's right or left hand, and the assembly 100 can be operated by palm and fingertip pressure regardless of its orientation relative to the person operating it, and vice versa.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

The invention claimed is:

1. A low profile, handle, housing and cover assembly comprising a relatively thick oval shaped handle sandwiched between a relatively thin oval shaped housing base and a relatively thin oval shaped front cover, wherein the oval shaped handle, the oval shaped housing base and the oval shaped cover are bounded by perimeter surfaces that define ovals of substantially the same size and shape, wherein the handle is pivotally connected to the housing base for being turned relative thereto about a forwardly-rearwardly extending central axis of the assembly between a non-operated position closely overlying the housing base and an operated position, and wherein the cover is pivotally connected to the handle for being turned relative thereto about a forwardly-rearwardly extending auxiliary axis between a closed position closely overlying the handle and an open position providing access to a forwardly opening keyway defined by a lock cylinder that extends along the central axis at least part way through the handle, wherein the cover has an oval front face surrounded by a forwardly projecting rim.

2. The assembly of claim 1 wherein a selected one of the cover and the handle has an apron formation that overlies an upwardly opening groove formation defined by the other of the cover and the handle, and at least one of apron formation and the groove formation is configured to divert rain water away from the lock cylinder.

3. The assembly of claim 2 wherein the cover carries the apron formation and is configured to move the apron formation away from the groove formation during movement of the cover away from the closed position.

4. The assembly of claim 1 wherein a selected one of the cover and the handle carries a glide block across which the other of the cover and the handle slides during movement of the cover between the closed and open positions.

5. The assembly of claim 1 wherein the lock cylinder extends along the central axis and is operable to move a tumbler transverse to the central axis to selectively permit and prevent turning of the handle about the central axis relative to the housing.

6. A low profile, handle, housing and cover assembly comprising a relatively thick oval shaped handle sandwiched between a relatively thin oval shaped housing base and a relatively thin oval shaped front cover, wherein the oval shaped handle, the oval shaped housing base and the oval shaped cover are bounded by perimeter surfaces that define ovals of substantially the same size and shape, wherein the handle is pivotally connected to the housing base for being turned relative thereto about a forwardly-rearwardly extending central axis of the assembly between a non-operated position closely overlying the housing base and an operated position, and wherein the cover is pivotally connected to the handle for being turned relative thereto about a forwardly-rearwardly extending auxiliary axis between a closed position closely overlying the handle and an open position providing access to a forwardly opening keyway defined by a lock cylinder that extends along the central axis at least part way through the handle, and further comprising a biasing device connected to the housing and the handle to bias the handle toward the non-operated position.

7. The assembly of claim 6 further comprising a biasing device connected to the cover and the handle to bias the cover toward the closed position.

8. The assembly of claim 6 wherein a stub shaft extends rearwardly along the auxiliary axis from the cover through a portion of the handle to pivotally connect the cover to the handle.

9. The assembly of claim 6 further comprising a cam carried by a rear portion of the handle that turns about the central axis in unison with the handle.

10. A lockable, low profile, handle, housing and cover assembly comprising a relatively thick oval shaped handle sandwiched between a relatively thin oval shaped housing base and a relatively thin oval shaped front cover, wherein adjacent pairs of the housing base, the handle and the cover pivotally connected to turn about forwardly-rearwardly extending axes, including a central axis about which the handle may turn relative to the housing base, and an auxiliary axis offset from the central axis about which the cover may turn relative to the handle, wherein the thin cover has a front surface configured to seat within the palm of one's hand so the cover can be turned by palm pressure between closed and open positions to selectively uncover and provide access to a keyway of a lock cylinder located beneath the cover, wherein the handle is of sufficient thickness so opposite elongate side portions thereof can be grasped and turned by fingertip pressure to pivot the handle between non-operated and operated positions, and wherein the oval shaped handle, the oval shaped housing base and the oval shaped cover are bounded by perimeter surfaces that define ovals of substantially the same size and shape, wherein the cover has an oval front face surrounded by a forwardly projecting rim.

11. The assembly of claim 10 wherein a selected one of the cover and the handle has a apron formation that overlies an upwardly opening groove formation defined by the other of the cover and the handle, and at least one of apron formation and the groove formation is configured to divert rain water away from the lock cylinder.

12. The assembly of claim 11 wherein the cover carries the apron formation and is configured to move the apron formation away from the groove formation during movement of the cover away from the closed position.

13. The assembly of claim 10 wherein a selected one of the cover and the handle carries a glide block across which the other of the cover and the handle slides during movement of the cover between the closed and open positions.

14. The assembly of claim 10 wherein the lock cylinder extends along the central axis and is operable to move a tumbler transverse to the central axis to selectively permit and prevent turning of the handle about the central axis relative to the housing.

15. A lockable, low profile, handle, housing and cover assembly comprising a relatively thick oval shaped handle sandwiched between a relatively thin oval shaped housing base and a relatively thin oval shaped front cover, wherein adjacent pairs of the housing base, the handle and the cover pivotally connected to turn about forwardly-rearwardly extending axes, including a central axis about which the handle may turn relative to the housing base, and an auxiliary axis offset from the central axis about which the cover may turn relative to the handle, wherein the thin cover has a front surface configured to seat within the palm of one's hand so the cover can be turned by palm pressure between closed and open positions to selectively uncover and provide access to a keyway of a lock cylinder located beneath the cover, wherein the handle is of sufficient thickness so opposite elongate side portions thereof can be grasped and turned by fingertip pressure to pivot the handle between non-operated and operated positions, and wherein the oval shaped handle, the oval shaped housing base and the oval shaped cover are bounded by perimeter surfaces that define ovals of substantially the same size and shape, and further comprising a biasing device connected to the housing and the handle to bias the handle toward the non-operated position.

16. The assembly of claim 15 further comprising a biasing device connected to the cover and the handle to bias the cover toward the closed position.

17. The assembly of claim 15 wherein a stub shaft extends rearwardly along the auxiliary axis from the cover through a portion of the handle to pivotally connect the cover to the handle.

18. The assembly of claim 15 further comprising a cam carried by a rear portion of the handle that turns about the central axis in unison with the handle.

19. A lockable handle, housing and cover assembly, comprising:

a) a relatively thin housing base bounded by a first oval perimeter surface;

b) a relatively thicker handle overlying the housing base and pivotal relative thereto about a central axis that extends forwardly from the housing base between a non-operated position wherein a second oval perimeter surface of the handle aligns with and extends forwardly from the first oval perimeter surface of the base, and an operated position wherein the second oval perimeter surface disaligns with the first oval perimeter surface;

c) a relatively thin cover overlying the handle and being movable relative to the handle between a closed position wherein a third oval perimeter surface of the cover substantially aligns with the second oval perimeter surface of the handle, and an open position wherein the cover disaligns with the second oval perimeter surface and provides access to a keyway of a lock cylinder of the assembly to enable a key to be inserted into and turned within the keyway to lock and unlock the lock cylinder to selectively prevent and permit turning of the handle relative to the housing about the central axis;

d) wherein the second oval perimeter surface of the handle has opposed elongate side surface portions that are graspable by fingers of the hand when the palm of the hand nests the cover so the handle can be turned by finger pressure between the non-operated and operated positions, and the cover can be moved by palm pressure between the open and closed positions; and, e) wherein the cover has an oval front face surrounded by a forwardly projecting rim.

20. The assembly of claim 19 wherein a selected one of the cover and the handle has an apron formation that overlies an upwardly opening groove formation defined by the other of the cover and the handle, and at least one of apron formation and the groove formation is configured to divert rain water away from the lock cylinder.

21. The assembly of claim 20 wherein the cover carries the apron formation and is configured to move the apron formation away from the groove formation during movement of the cover away from the closed position.

22. The assembly of claim 19 wherein a selected one of the cover and the handle carries a glide block across which the other of the cover and the handle slides during movement of the cover between the closed and open positions.

23. The assembly of claim 19 wherein the lock cylinder extends along the central axis and is operable to move a tumbler transverse to the central axis to selectively permit and prevent turning of the handle about the central axis relative to the housing.

24. A lockable handle, housing and cover assembly, comprising:

a) a relatively thin housing base bounded by a first oval perimeter surface;

b) a relatively thicker handle overlying the housing base and pivotal relative thereto about a central axis that extends forwardly from the housing base between a non-operated Position wherein a second oval perimeter surface of the handle aligns with and extends forwardly from the first oval perimeter surface of the base, and an operated position wherein the second oval perimeter surface disaligns with the first oval perimeter surface;

c) a relatively thin cover overlying the handle and being movable relative to the handle between a closed position wherein a third oval perimeter surface of the cover substantially aligns with the second oval perimeter surface of the handle, and an open position wherein the cover disaligns with the second oval perimeter surface and provides access to a keyway of a lock cylinder of the assembly to enable a key to be inserted into and turned within the keyway to lock and unlock the lock cylinder to selectively prevent and permit turning of the handle relative to the housing about the central axis;

d) wherein the second oval perimeter surface of the handle has opposed elongate side surface portions that are graspable by fingers of the hand when the palm of the hand nests the cover so the handle can be turned by finger pressure between the non-operated and operated positions, and the cover can be moved by palm pressure between the open and closed positions; and, e) a biasing device connected to the housing and the handle to bias the handle toward the non-operated position.

25. The assembly of claim 24 further comprising a biasing device connected to the cover and the handle to bias the cover toward the closed position.

26. The assembly of claim 24 wherein a stub shaft extends rearwardly from the cover through a portion of the handle to connect the cover to the handle for pivotal movement relative to the handle about an auxiliary axis that extends substantially parallel to and is spaced from the central axis.

27. The assembly of claim 24 further comprising a cam carried by a rear portion of the handle to be turned about the central axis in unison with the handle.

* * * * *